US005703603A

United States Patent [19]

Korzhenkov et al.

[11] Patent Number: 5,703,603

[45] Date of Patent: Dec. 30, 1997

[54] MULTI-BEAM LENS ANTENNA

[75] Inventors: Petr Nikolaevich Korzhenkov; Jury Leonidovich Pyait; Alexandr Semenovich Smagin; Alexandr Lvovich Epshtein, all of Moscow, Russian Federation

[73] Assignee: Tovarischestvo S Ogranichennoi Otvetstvennostju "Konkur", Moscow, Russian Federation

[21] Appl. No.: 578,702

[22] PCT Filed: Apr. 28, 1994

[86] PCT No.: PCT/RU94/00097

§ 371 Date: Dec. 27, 1995

§ 102(e) Date: Dec. 27, 1995

[87] PCT Pub. No.: WO95/30254

PCT Pub. Date: Nov. 9, 1995

[51] Int. Cl.[6] ..... H01Q 3/14; H01Q 19/06

[52] U.S. Cl. ..... 343/753; 343/765; 343/882

[58] Field of Search ..... 343/878, 880, 343/882, 840, 915, 916, 753, 765; H01Q 19/06, 3/14

[56] References Cited

U.S. PATENT DOCUMENTS

| | | | |
|---|---|---|---|
| 3,230,536 | 1/1966 | Cheston | 343/754 |
| 3,404,405 | 10/1968 | Young | 343/754 |
| 4,656,486 | 4/1987 | Turner | 343/882 |

FOREIGN PATENT DOCUMENTS

| | | |
|---|---|---|
| 2 127 624 | 9/1983 | United Kingdom . |
| 2 190 246 | 4/1987 | United Kingdom . |
| 85/05437 | 12/1985 | WIPO . |
| 93/02486 | 2/1993 | WIPO . |

*Primary Examiner*—Michael C. Wimer
*Attorney, Agent, or Firm*—Lowe, Price, LeBlanc & Becker

[57] ABSTRACT

The multi-beam lens antenna contains a spherical centro-symmetric lens (1), fixed by means of joints (3) fastening it to a frame (2) in the form of an ellipse, so that the center of the lens (1) lies outside the plane of the frame (2). The frame (2) is installed on the base (4) and able to turn relative to the horizontal plane. The antenna also contains illuminators (8), positioned on the semi-circle guide (9), connected to the frame (2) by means of fastening joints (11). The joints (3, 11) fastening the lens (1) and the semi-circle guide (9) to the frame are constructed as self-positioning in their angle placement and adjustable with the possibility of moving along their axes. The semi-circle guide (9) is located in the plane parallel to the plane which passes through the center of the lens (1) and the long axis of the frame (2), while the frame (2) is positioned on an aligning base (4) able to turn the statically imbalanced lens (1), the frame (2), and the semi-circle guide (9) relative to the long axis of symmetry of the frame (2), with the resulting fixation of the position of the frame (2).

5 Claims, 2 Drawing Sheets

MULTI-BEAM LENS ANTENNA

TECHNICAL FIELD

The present invention relates to the field of antenna engineering, specifically, to a multi-beam lens antenna.

BACKGROUND ART

A known multi-beam lens antenna (RST/SU 91/00145) consists of a centro-symmetric spherical lens, secured to the foundation with the aid of a frame, and capable of changing the angle between the plane of the frame and the horizontal plane, and a semi-circle guide with attachment subassemblies and adjustment of illuminator position. This antenna provides for simultaneous reception of signals emitted by various sources, such as satellites.

The design of this lens ensures a practically unchanging value for the gain directed toward all signal sources (satellites), positioned at various points on the geostationary orbit. The known multi-beam lens antenna may easily be directed toward any position of the geostationary satellites. In addition to this, it provides for attachment of the spherical centro-symmetric lens to the frame with the aid of two identical rods, each of which is attached at one end to the frame at the point lying on its shorter axis of symmetry, with the same incline toward the plane of the frame, and meeting each other in the plane perpendicular to the plane of the frame. Upon installation of the spherical lens with frame, assembly tensions develop in the design, caused by the imprecision in production of the connecting surfaces, which leads to a decrease in the dependability of the antenna.

Upon loading and unloading, transportation and hoisting of the antenna to the building or other structures, the inertial forces which act on the spherical lens lead to deformation of the frame and the appearance of additional tensions in the frame construction and the spherical lens, which also decreases the reliability of the antenna, since the margin of stability of the spherical lens cannot be great, as it is made of materials which possess a high level of radio engineering characteristics and a comparatively low level of stability. The method used for strengthening the spherical lens demands precise mechanical engineering of the connecting surface and the control assembly, which increases the antenna's production cost.

In the known antenna the frame is fastened to the base by its lower section, and the center of the spherical lens is located high above the supporting surface of the base, which leads to the development of a significant moment of overturn under the force of winds and makes necessary fastening the antenna to the roof of the building or structure, which increases the cost of the assembly work. In addition to this, the means adopted for fastening the frame to the base leads under conditions of transportation to the appearance of additional tensions in the design, since the mass center of the spherical lens stands off from the incline axis of the frame by an amount equal to the smaller semiaxis of the frame, which results in a decrease in the antenna's reliability. Insofar as at the same time the spherical lens statically is not balanced relative to the base, at the stage of assembly particular accuracy directed toward the spherical lens is necessary, which requires the use of qualified personnel and also carries an increase in the cost of the set-up and adjustment operations. In the known antenna the semi-circle guide is rigidly attached to the frame. This type of attachment demands precise manufacture of the connecting surfaces and makes adjustment of the position of the semi-circle guide into its plane impossible. Such adjustment is necessary to compensate for the technical scattering/dissipation of the focal distance of the spherical lens, and increases the production cost of the antenna. In addition to this, the plane of the semi-circle guide passes across the center of the spherical lens and is perpendicular to the axis of the spherical lens, passing through its polar points. At the same time the semi-circle guide does not permit the installation of illuminators in the optimal position, at which their axes lie in the plane perpendicular to the plane of the frame and pass through the longer axis of the frame, although such positioning of the illuminators would result in minimal influence of the frame and the lens attachment angles on the excitation of the lens by all its illuminators, and the corresponding maximal antenna gain from all beams formed by it.

Due to the static imbalance of the spherical lens relative to the incline axis of the frame, the lead screw sustains a significant load, as a result of which the incline mechanism of the frame has a complex design and a high production cost.

In the known antenna, support for construction on a roof is not provided for, as a result of which disruption of the alignment and decrease in the effectiveness of reception are possible.

DISCLOSURE OF THE INVENTION

The basis of the present invention is the task of creating a multi-beam lens antenna of a design which provides simplification and acceleration of the process of assembly and construction, with a simultaneous increase in the stability of the antenna's use parameters over time, while ensuring that a maximal gain is provided in the process of adjustment for all antenna beams formed.

The problem posed is solved by the fact that in the multi-beam lens antenna, which contains: (a) a spherical centro-symmetric lens fastened by angle joints to a frame in the form of an ellipse so that the lens center lies outside the plane of the frame, positioned on the base with the capability of rotating relative to the horizontal plane; and (b) illuminators arranged on the semi-circle guide, connected to the frame by means of fastening joints, and positioned from the sides opposite the placement of the lens center. According to the invention, the joints fastening the lens and the semi-circle guide to the frame are constructed as self-positioning in their angle placement and adjustable, capable of moving along their axes, in addition to which the semi-circle guide is positioned in the plane parallel to the plane which passes across the center of the lens and the long axis of the frame, while the frame is positioned on the aligning surface and it is possible to turn the statically imbalanced lens, frame and semi-circle guide relative to the frame's long axis of symmetry and the resulting fixing of the frame position.

Such a design solution is technologically achievable, ensuring the simplicity of assembly and transportation of the antenna, and ensuring that a high level of mechanical reliability of the design is achieved at low cost. Positioning of the semi-circle guide in the plane parallel to the plane which passes through the lens center and the longer axis of the frame, permitting placement of the illuminators in the optimal position, at which their axes lie in the plane perpendicular to the frame and which passes through the longer axis of the frame. With such positioning a maximal gain of the antenna is obtained, and, correspondingly, maximal effectiveness of reception.

In addition, the static imbalance of the system significantly simplifies the conduct of all operations in a technological cycle. A high positioning of the rotational axis of the frame permits a low-height design and, consequently, a low aerodynamic load, which makes fastening the antenna to the roof of the building or assembly site unnecessary.

It is advisable that each of the joints fastening the lens to the frame contain a bracket rigidly connected to the frame, in whose threaded opening is inserted a threaded screw which can be moved in a continuous direction, with a round head, connected by a conical support to the lens.

Such a construction of the joints fastening the lens to the frame permits a significant decrease in the loads which act on the lens flanges at all stages of the technological cycle—in assembling the frame with the spherical lens, transportation, and fixing on the assembly object. The adoption of two spherical supports and the possible movement of the screws along the axis by the threads makes it possible to set up the lens and frame even given a high level of technological deviation in the constructions of either the frame or the lens. Extremely precise conditioning of the installation site for the frame and lens is not required, which lowers the production cost of the antenna. It is preferred that each of the joints fastening the semi-circle guide to the frame contain: (a) a threaded screw with a round head, connecting the semi-circle guide (with the possibility of moving in a continuous direction) and with the matching part of the round support fixed on the frame; and (b) a conical nut for fixing the position of the threaded screw; and (c) a plate connected to the junction plate, fastened in corresponding fashion to the frame and the semi-circle guide.

Such a design realization of the fastening joints ensures that adjustment of the position of the semi-circle guide is possible and technologically effective, since a high degree of precision of the connecting parts is not required. In case the technological shift of the lens's focal distance turns out to be great and the scale of the fastening joint and adjustment of the position of the illuminators is insufficient for compensation of this shift, the use of plates of various sizes, and threaded screws corresponding to the repositioning permits movement of the semi-circle guide relative to the lens.

It is helpful if the fixing of the frame position is carried out using nuts positioned along both sides from the bracket, connected to the base on the axes, rigidly connected to the frame.

Such a method of fixing the frame permits dispensing with complex mechanisms for fixing the incline angles of the frame and significantly lowers the production cost of the antenna It is necessary that in the alignment base there be introduced supplementary center plates, each of which contains a threaded screw with a round head, connected with the support of the base which shall be capable of moving along the screw axis, and a supporting plate, connected to the round support by the cover.

Such a design realization permits fixing the antenna on the soft roof of a building and preserves the stability of the alignment, and, consequently, effectiveness of reception.

BRIEF DESCRIPTION OF THE DRAWINGS

The invention proposed below is explained using a concrete example of its construction and the drawings provided, in which.

BEST MODE FOR CARRYING OUT THE INVENTION

Figure 1:
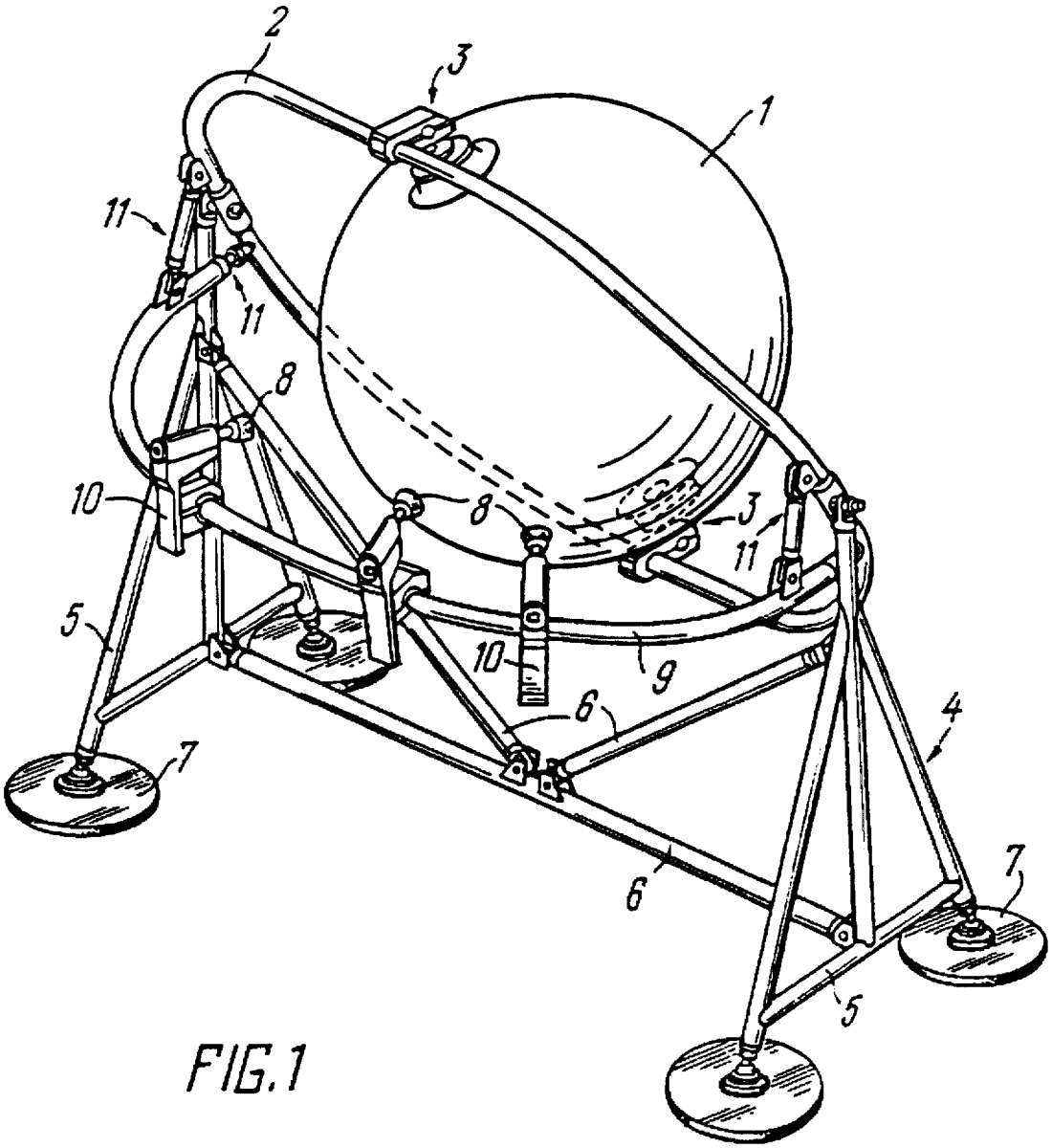
FIG. 1 depicts a general view of the multi-beam lens antenna, according to this invention.

The multi-beam lens antenna according to this invention contains centro-symmetric spherical lens 1 (FIG. 1), fixed to frame 2 with the aid of adjustable spherical fastening joints (3). The frame 2 can be realized in the form of any closed curve that has two axes of symmetry perpendicular to one other. The best realization of frame 2 is in the form of an ellipse, in which the length of the short axis must exceed the diameter of the spherical lens 1. In this case the rigidity of the design and its capability to withstand the weight of lens 1 loaded on it are ensured, as well as the technological effectiveness of the frame 2.

The frame 2 is fastened to the base 4 with the possibility of rotation relative to its longer axis of symmetry. The base 4 is made in a collapsible/sectional fashion and consists of two girders 5, which are connected to each other by means of screws 6 and are fixed on the support plates 7.

The antenna also contains the illuminators 8, fixed on the semi-circle guide 9 with aid of the joints for fastening and adjusting position, which ensures the possibility of repositioning each illuminator 8 along the semi-circle guide 9, along its own axis in the direction of the center of the lens 1, and also in the direction perpendicular to the plane of the semi-circle guide, and rotation of the illuminator 8 around the axis and its subsequent fixation. The guide 9 is fastened to the frame 2 with the aid of two adjustable fastening joints 11 from the sides opposite the points where the fastening joints 3 of the lens are fixed to the frame 2.

Figure 2:
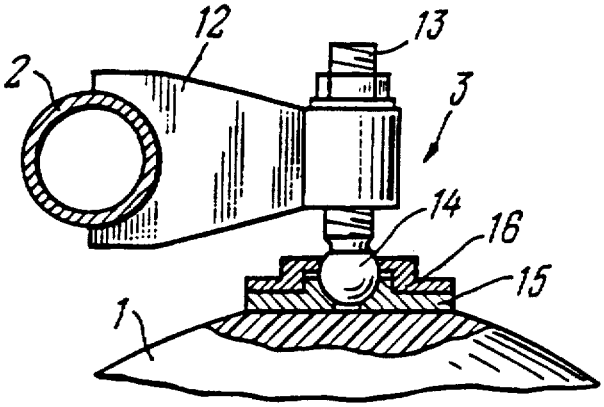
FIG. 2 illustrates a unit for fastening the lens to the frame, according to this invention.

Each spherical joint 3 (FIG. 2) fastening lens 1 to frame 2 comprises a bracket 12, rigidly connected to the frame 2, a threaded screw 13 with a round head 14, fixed in the threaded opening of the bracket 12 and able to turn, the flange 15, rigidly connected to lens 1 and the cover 16 of the round support.

Figure 3:
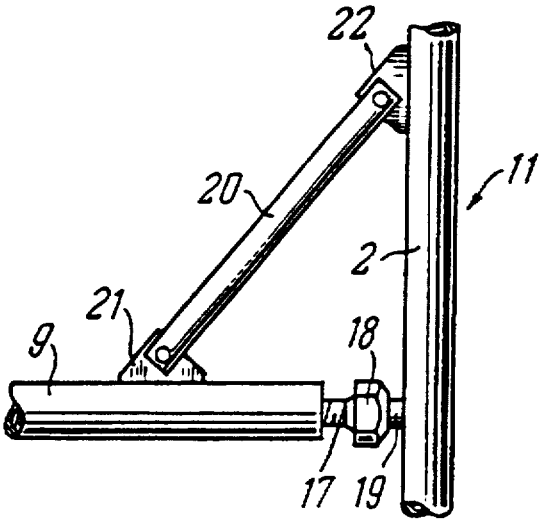
FIG. 3 illustrates a unit for fastening the semi-circle guide to the frame, according to this invention.

As shown in FIG. 3, each fastening joint 11 of the guide 9 to the frame 2 consists of a threaded screw 17 with a round head, which is fixed in the guide 9 and by means of conical nut 18 is connected to the corresponding part of the round support 19, located on the frame 2. In addition, joint 11 contains plate 20, which connects gusset plates 21 and 22, fastened correspondingly to guide 9 and frame 2.

Figure 4:
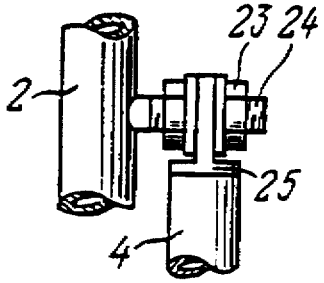
FIG. 4 shows a unit for fastening the frame to the base, according to this invention.

For fixing the incline angle of frame 2 (FIG. 4) relative to the horizontal plane, nuts 23 are used, located on axle 24, rigidly connected to frame 2, along both sides for the bracket 25 of base 4.

Figure 5:
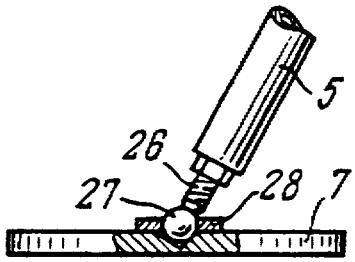
FIG. 5 illustrates a center plate of the base, according to this invention.

On the base 4 (FIG. 1) are introduced connecting plates, each of which consists of a threaded screw 26 (FIG. 5), with a round support 27, fixed on the girder 5, and able to move along its axis, and the supporting plates 7, connected to the round support 27 with the aid of the cover 28.

The antenna must be installed on the roof of a building or in any open place, from which the best view is available of the region where the subscribers to the terrestrial system of multi-channel communications are located, or of the segment of the geostationary orbit. The process of assembly and alignment of the antenna is carried out in the following manner. First, the base 4 (FIG. 1) is assembled and oriented in such a way that the plane perpendicular to the rotational axis of the frame 2 is directed approximately toward the center of the region where the subscribers for the terrestrial multi-channel system of communications are located, or in the North to South direction for a satellite television system. Then the frame 2 is connected to the lens 1, using the adjustable joints 3, positioned on the frame 2. Frame 2 is fixed on the base 4 and is connected to the semi-circle guide 9. The center of lens 1 must be extended from the plane of frame 2 in the direction of the subscribers for a terrestrial multi-channel communications system or in a southern direction for a satellite television system, if the antenna is located in the Northern hemisphere; for the Southern hemisphere, the center of lens 1 must be extended to the north direction.

With the aid of the adjustable fastening joints 11 a position is attained such that the plane of the semi-circle guide 9 is perpendicular to the plane of the frame 2. The frame 2 is rotated until the plane of frame 2 is perpendicular to the horizontal plane, for a terrestrial multi-channel system of communications. For a satellite television system, the angle between the plane of frame 2 and the horizontal plane must correspond to the latitude of the antenna's installation site. After this, nuts 23 (FIG. 4) placed on the rotational axes 24 of frame 2, are tightened. On the semi-circle guide 9 (FIG. 1), the fastening joints 10 are positioned, and the adjustment of the position of the illuminators and of the illuminators themselves 8 is carried out, so that the number of illuminators 8 is equal to the number of subscribers (satellites) with which communication is to be established. Each illuminator 8 is oriented in the direction to the center of lens 1 and to the corresponding subscriber (satellite) by moving each fastening joint 10 along the semi-circle guide 9, and each illuminator 8 on the fastening joint 10 along a line perpendicular to the plane of the semi-circle guide 9, and then is fixed. The juxtaposition of the phase center of each illuminator 8 with the focal surface of the lens 1 is provided by the movement of each illuminator 8 in the direction of the center of the lens 1 until a maximum signal is received. Then a parallel polarization readjustment is conducted by rotating the illuminator against its axis until the maximum signal is received. After this the antenna is ready for operation as part of a terrestrial multi-channel communications system or as part of a satellite television system.

In the course of operation, an electromagnetic wave emitted by the signal source (subscriber) or the satellite from one direction falls on the lens 1, which focuses it on one of the illuminators 8 and receives it.

In a satellite television system the signal received is transformed by frequency to the range of television signals of one of the channels, is mixed onto other frequency channels by signals with the output of the other illuminators 8 and enters the television receiver, where the choice of programs is carried out by a normal channel-changing device.

In this manner, the proposed antenna is easily and reliably adjusted (tuned) to any arrangement of the sources (satellites in geostationary orbit) visible from the antenna installation site. The antenna has a low production cost, can be easily transported and installed on the assembly object, has a maximal possibility for a concrete lens gain and provides for reliable functioning.

I claim:

1. Multi-beam lens antenna, comprising:

a centro-symmetric spherical lens fixed by means of first fastening joints to an elliptical frame having a long axis and a short axis, so that the center of the lens lies outside the plane of the frame, said frame being supported by a base and being capable of rotating relative to the base, and illuminators positioned on a semi-circle guide joined to the frame by means of second fastening joints and installed from the side opposite the position of the lens center, wherein each of said first joints comprises a screw member coupled to the frame and having a round head engaged with a support member attached to the lens, to enable adjustment of the lens with respect to the frame, the semi-circle guide is arranged in a plane parallel to the plane which passes through the center of the lens and the long axis of the frame, and the base is adapted to rotate the lens, the frame and the semi-circle guide relative to the long axis of the frame to enable alignment of the lens.

2. Multi-beam lens antenna as described in claim 1, wherein each of the first joints further comprises a bracket rigidly connected to the frame and having a threaded opening for receiving said screw member having a threaded screw capable of turning in a continuous direction.

3. Multi-beam lens antenna as described in claim 1, wherein each of the second joints comprises a threaded screw member inserted into the semi-circle guide so as to be capable of moving with respect to the guide, and coupled with a round support arranged on the frame, and each of the second joints further comprises a conical nut for fixing the position of the threaded screw member with respect to the guide, and a plate for connecting the frame and the semi-circle guide.

4. Multi-beam lens antenna as described in claim 1, wherein fixing the position of the frame is carried out by means of nuts supported by an axle rigidly connected to the frame.

5. Multi-beam lens antenna as described in claim 1, wherein the base further comprises a supplementary center plate which comprises a threaded screw having a round support and connected with a girder movable along the axis of the screw, and a supporting plate connected to the round support.

* * * * *